US006745451B1

(12) United States Patent
Braunberger

(10) Patent No.: US 6,745,451 B1
(45) Date of Patent: Jun. 8, 2004

(54) ADAPTER FOR MACHINE FOR MANUFACTURING BUTTONS AND METHOD

(75) Inventor: Benjamin A. Braunberger, Fond du Lac, WI (US)

(73) Assignee: Tecre Co., Inc., Fond du Lac, WI (US)

( * ) Notice: Subject to any disclaimer, the term of this patent is extended or adjusted under 35 U.S.C. 154(b) by 24 days.

(21) Appl. No.: 10/177,693

(22) Filed: Jun. 21, 2002

Related U.S. Application Data

(63) Continuation-in-part of application No. 09/473,290, filed on Dec. 28, 1999, now Pat. No. 6,431,027, which is a continuation-in-part of application No. 08/899,613, filed on Jul. 24, 1997, now Pat. No. 6,038,944.

(51) Int. Cl.[7] ..... B21D 39/00; B23P 11/00; D04D 7/04

(52) U.S. Cl. ..... 29/509; 29/505; 29/243.529; 29/243.519; 79/4

(58) Field of Search ..... 29/429, 243.529, 29/243.519, 4, 505, 509, 428; 79/4, 1, 3, 5

(56) References Cited

U.S. PATENT DOCUMENTS 3,600,783 A * 8/1971 Krinsky et al. ..... 29/243.517
3,795,036 A * 3/1974 Roebuck ..... 29/243.519
4,346,507 A * 8/1982 Heuck ..... 29/243.519

* cited by examiner

*Primary Examiner*—John C. Hong
(74) *Attorney, Agent, or Firm*—Donald Cayen

(57) ABSTRACT

An adapter enables a universal assembly machine to manufacture buttons with either flat backs or formed backs. The machine comprises a rotatably indexable die table to which are mounted pickup and crimp dies. A ram die is advancable and retractable in a pickup stroke and a crimp stroke. Indexing the die table causes a shifter post to rotate a ram outer ring into a pickup mode or a crimp mode to suit the ram pickup and crimp strokes, respectively. The universal assembly machine manufactures buttons with flat backs by using the adapter on the same crimp die pedestal as is used for manufacturing buttons with formed backs. The adapter has a top surface that is in the location relative to the ram die that suits flat back buttons. The adapter enables the same crimp die pedestal to be used for manufacturing both flat back and formed back buttons.

5 Claims, 8 Drawing Sheets

131
130
168
175
133
177
173
179
181
127

4
97
31
113
120
119
109
121
115
117
123
34
35
87
89
130
125
107
43
137
129
127
33
135
43
39
111
131
139
141
83
72
64
60
68
46
5
5
4
57
37
C
143
41
46
53
47
65
69
71
67
45
51
70
81
77
75
86
133

55
49
66
85
55
47
66
63
59
73
95
93

ADAPTER FOR MACHINE FOR MANUFACTURING BUTTONS AND METHOD

This is a continuation-in-part of U.S. patent application Ser. No. 09/473,290 filed Dec. 28, 1999 now U.S. Pat. No. 6,431,027 which is a continuation-in-part of U.S. patent application Ser. No. 08/899,613 filed Jul. 24, 1997, now U.S. Pat. No. 6,038,944.

BACKGROUND OF THE INVENTION

1. Field of the Invention

This invention pertains to buttons, and to apparatus and methods for manufacturing buttons.

2. Description of the Prior Art

For the purposes of this invention, the term "button" is used herein to describe a multi-component assembly as shown in FIGS. 1, 1A, and 1B. A flexible laminate 1, which normally includes a sheet of artwork 3 and a protective transparent film 5, is overlaid on a domed shell 7 having an annular wall 8. However, it is not necessary that the artwork 3 and transparent film 5 be bonded to each other. The term "laminate" includes artwork and transparent films that are both separated pieces and bonded pieces. The laminate 1 has a skirt portion 11 that overhangs the free edge 13 of the shell wall 8. A formed back 9, which is usually made of steel, is placed against the shell in a manner that tucks the skirt 11 of the laminate around the free edge 13 of the shell wall. The shell wall is crimped around its free edge against an outer frusto-conical wall 15 of the back 9, thereby bending the wall 8 of the shell and assembling the button 17. The finished button 17 has a three dimensional appearance that enhances the visual appeal of the artwork 3. It will be noticed that the shell wall has become frusto-conical in shape, as is shown at reference numeral 19, and also that the laminate skirt is tucked between the shell wall 19 and the back wall 15. Those two structural features are characteristic of buttons. FIG. 1C shows a typical prior button 18 that is made with a collet 20 instead of a formed back 9.

Machines for manufacturing buttons 17 are well known. For example, my U.S. Pat. No. 4,829,662; 4,867,013; 6,038,944; and U.S. Pat. Des. No. 308,529 show exemplary button presses capable of high speed production. Other apparatus for making buttons may be seen in U.S. Pat. No. 966,778; 988,478; 1,196,076; 3,661,039; 3,662,626; 3,662,627; 3,698,065; 3,795,036; and 4,696,086.

The Parisian Novelty Company of Chicago, Ill., manufactures a pneumatically operated button assembly machine having a C-shaped frame. The Parisian machine includes two work stations in the form of separate sets of dies. The die sets are mounted on a turntable that is indexable through approximately 90 degrees by means of a manually gripped handle to place the correct die set under a reciprocable ram. The C-shaped frame requires a heavy and complicated cast metal structure with intricate machining.

The Technical Products Company of Hubertus, Wis., markets a button assembly machine in which two sets of dies are mounted on a slide. The slide is reciprocable to place the desired die set under a ram. Another Technical Products machine has two die sets arranged in a stack. The stack is invertible to locate the desired die set directly under the ram. Both Technical Product machines have C-shaped frames.

The Instant Buttons Machine Manufacturing Company of Hamden, Conn., markets a semi-automatic button machine having an H-shaped frame. Two sets of dies are mounted on a slide that reciprocates to place the desired set under a ram. An artwork cutout device is included as part of the machine frame. That is a disadvantage, because if either a cutout or an assembly component fails, the entire process is compromised. In addition, production is less than optimum because the machine can be used only for cutting or button making at one time, which prevents simultaneous operation of the cutting and assembly functions by different persons. Another drawback of the Instant Buttons machine is that the handle for operating the ram falls outside of the machine base. Consequently, the entire machine tends to tip over with every handle stroke.

By way of the further background, the term "medallion" historically meant a thin flat disk bearing artwork usually produced by engraving. The medallion was usually set into a shallow recess in the body of a trophy, medal, or other award assembly and bonded there by an adhesive. Looking at FIGS. 2, 2A, and 2B, reference numeral 30 indicates any of a wide variety of conventional trophies with which medallions were commonly used. The trophy 30 had a shallow standard-sized circular recess with a flat seat 36. The diameter of the seat 36 was one inch or two inches; in European trophies the corresponding diameters were 25 millimeters and 50 millimeters, respectively. Reference numeral 32 indicates a medallion that fit within the trophy recess. The recess located the medallion 32 relative to the other features of the trophy 30 and also covered the medallion raw edge 38. Covering the medallion edge 38 was important for aesthetic purposes. The medallion gave a customized appearance to an otherwise generic award such as the trophy 30. However, due to engraving limitations, the medallions 32 were no more than flat disks, as mentioned, usually bearing some simple generic artwork. The flat prior medallion thus lacked a rich appearance and tended to diminish the overall image of the trophy.

The widespread availability of desktop publishing, together with the proliferation of myriads of colorful clipart and artistic fonts, enables any button maker to incorporate colorful customized artwork to commemorate any event worthy of an award. However, buttons 17 (FIG. 1B) have not been used to embellish trophies and awards because the incorporated recesses are too shallow to hide the thick and unattractive button edges. Also, buttons are not of a size that fit the standardized recesses in awards components. FIG. 2C illustrates the incompatibility of buttons and awards. In FIG. 2C, a button 17 is shown placed in the recess of a trophy 30. The button edge 42 projects above the front surface 44 of the trophy, which is unacceptable from an appearance standpoint. The fact that the button edge 42 is above the trophy surface 44 also makes it difficult to accurately center the button on the seat 36. Further, the relatively great distance between the trophy seat and the button formed back 9 makes it difficult to adhere the button to the seat.

Despite the availability of different kinds of button manufacturing machines, it is desirable to make further improvements to them.

SUMMARY OF THE INVENTION

In accordance with the present invention, an adapter is provided that enables a universal assembly machine to manufacture different kinds of buttons. This is accomplished by using the adapter to compensate for the differences in the relative locations of a pedestal and a ram required for different kinds of buttons.

The universal assembly machine includes a die table that is rotatably indexable about a column of a box frame to locate a selected one of two sets of dies under a reciprocable ram. The die table is supported by a base that is part of the machine box frame. The die table is indexable about a center column that upstands from the base. A crown is attached to the tops of the center column and an end column. A shifter post has one end joined to the die table and is closely spaced to the frame center column. Consequently, indexing the die table about the center column causes the shifter post to travel in an arc about the center column. Cutouts in the die table contact the end column to accurately locate the die table at two index positions.

The ram is guided in and supported by the frame crown for reciprocating along a vertical axis. Guidance of the ram is by guide elements passing through guide holes in the crown and fixed in a ram plate on the underside of the crown. The ram plate is further guided by one or both of the end column and the center column. One or more ram springs bias the ram plate toward the underside of the crown. There are a pair of holes in the ram plate on opposite sides of the vertical axis.

Fastened to the ram plate is one end face of an inner plug. The second end face of the inner plug is concave. An outer ring is slideable and rotatable on an outer diameter of the inner plug. An internal shoulder on the outer ring is contactable with an external shoulder of the inner plug. A pair of pins is pressed into a first end face of the outer ring. The pins extend toward the ram plate. There is a clearance between the free ends of the pins and the ram plate when the ram plate is retracted against the crown.

First and second fingers are pressed into and jut outwardly from the outer periphery of the ram outer ring. The fingers closely straddle the frame center column and the die table shifter post when the die table is at either of its index positions.

On the opposite ends of the die table are mounted two sets of dies. The first set is a pickup die that comprises a cylindrical pickup die pedestal fastened at one end to the die table. The opposite end of the pickup die pedestal is shaped to support the inside of a button shell. An outer ring is slideable over the pickup die pedestal. The outer ring has an internal shoulder that is biased against an external shoulder of the pickup die by one or more springs acting against the die table.

The second set of dies comprises a crimp die having a crimp die pedestal that is fastened to the die table. An outer ring is slideable over the crimp die pedestal. A spring force biases the crimp die outer ring such that shoulders on the crimp die pedestal and outer ring abut. The upper face of the crimp die pedestal has a counterbore.

To operate the universal assembly machine, a handle that is pivotably connected to the crown is initially pivoted to a ready position. In that position, the ram spring biases the ram plate against the frame crown and away from the die table. A button shell is placed dome upward on the pickup die pedestal. An artwork laminate that is to be assembled to the shell is placed in a counterbore in the pickup die outer ring above the shell. The die table is indexed to place the pickup die under the ram. The shifter post contacts the first finger on the ram outer ring and locates the outer ring in a pickup mode such that the pins in the outer ring are not aligned with the holes in the ram plate. The outer ring second finger is then adjacent the frame center column. The ram outer ring is positively held in the pickup mode by the cooperation of both fingers with the frame center column and the shifter post.

The handle is pivoted in a pickup stroke from a ready position to a working position. Doing so causes a handle to engage the ram plate and advance the ram downwardly toward the pickup die. The ram plate advances through the initial clearance with the pins. After the ram plate contacts the pins, the ram plate, acting through the ram outer ring, forces the pickup die outer ring downwardly against the spring force in the pickup die outer ring. Simultaneously, the ram inner plug and a cylindrical inner surface of the outer ring form the laminate to conform to the shape of the shell. At the end of the pickup stroke, the laminate is fully formed over the shell and is held, together with the shell, by friction in the ram outer ring. There is a skirt of the laminate overhanging the free edge of the shell. Reverse pivoting of the handle back to the ready position enables the ram to retract, with the shell and laminate held by friction in the ram outer ring. A formed button back having a frusto-conical outer wall is placed on the crimp die pedestal.

The die table is then indexed about the frame center column to place the crimp die under the ram. Rotating the die table causes the shifter post to contact the second finger in the ram outer ring and rotate the outer ring to a crimp mode such that the pins in the ram outer ring become aligned with the holes in the ram plate. When the outer ring is in the crimp mode, the second finger is adjacent the shifter post, and the first finger is adjacent the frame center column. Pivoting the handle toward the working position advances the ram in a crimp stroke. The laminate and shell advance toward the button back. Advancing the ram first causes the laminate skirt to bend over the free edge of the shell and to tuck between the shell and the frusto-conical outer wall of the formed back. Continued pivoting of the handle crimps the artwork and shell rim against the frusto-conical outer wall of the button back. Upon reverse pivoting of the handle, the ram retracts to expose the assembled button.

A further feature of the universal assembly machine is that it is exceptionally stable during operation. One reason for the stability is that the frame base is long enough to underlie the entire handle when the handle is pivoted to its working position. Consequently, there is no tendency for the machine to tip during operation. As a related reason, all of the machine components are completely over the base during operation of the handle.

The universal assembly machine is also capable of manufacturing buttons having flat backs. The same machine components and operations are used as described previously with but one exception. Because of the difference in height between the prior formed back 9 with the frusto-conical outer wall 15 and a flat back, a different crimp die pedestal is required. Alternately, and in keeping with the present invention, the same crimp die pedestal can be used with an adapter that compensates for the different heights of the formed and flat backs. Whether or not the adapter is used, the skirt of the laminate of the completed button is tucked between the periphery of the flat back and a shell frusto-conical wall, as is characteristic of buttons.

A button medallion is also manufacturable using the universal assembly machine. The button medallion has a three-dimensional appearance that is far richer than prior flat medallions. The button medallion is composed of a flexible laminate, a shell, and a flat back. The manufacturing process begins with the manufacture of a button with a flat back. After the crimp stroke, the flat back button is transferred to the pickup die. The machine die table is again indexed to place the pickup die under the ram. The ram is advanced in a third press stroke such that the ram inner plug contacts the periphery of the flat back button and forces the frusto-conical wall of the shell against the pickup die pedestal. The result is that the frusto-conical wall of the shell forms inwardly over against the back and comes to lie in a flat plane. The finished product is a three-dimensional button medallion that can be bonded to a trophy or the like with adhesive in the manner of prior medallions and whose outside edge is thin enough to be substantially hidden in the trophy recess.

The method and apparatus of the invention, using a universal assembly machine, thus enables buttons to be manufactured in an economical and efficient manner. Buttons with either formed or flat backs are manufacturable using the universal assembly machine by making only a minor adaptation to one of the machine dies.

Other advantages, benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Assembly Machine

Figure 1:
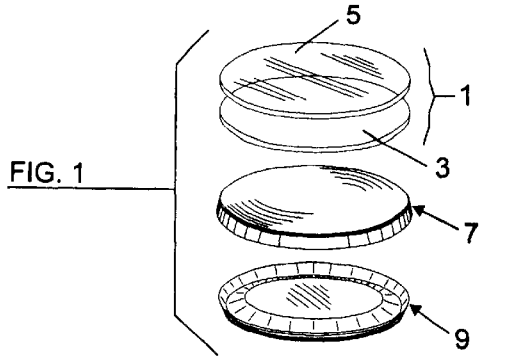
FIG. 1 is an exploded perspective view of a prior button.
Figure 1A:
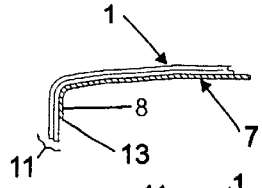
FIG. 1A PRIOR ART
FIG. 1A is a partial cross sectional view of a prior button shown in a partially assembled condition.
Figure 1B:
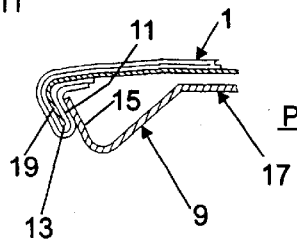
FIG. 1B PRIOR ART
FIG. 1B is a partial cross sectional view of the button of FIG. 1A, but showing the button in the fully assembled condition.
Figure 15A:
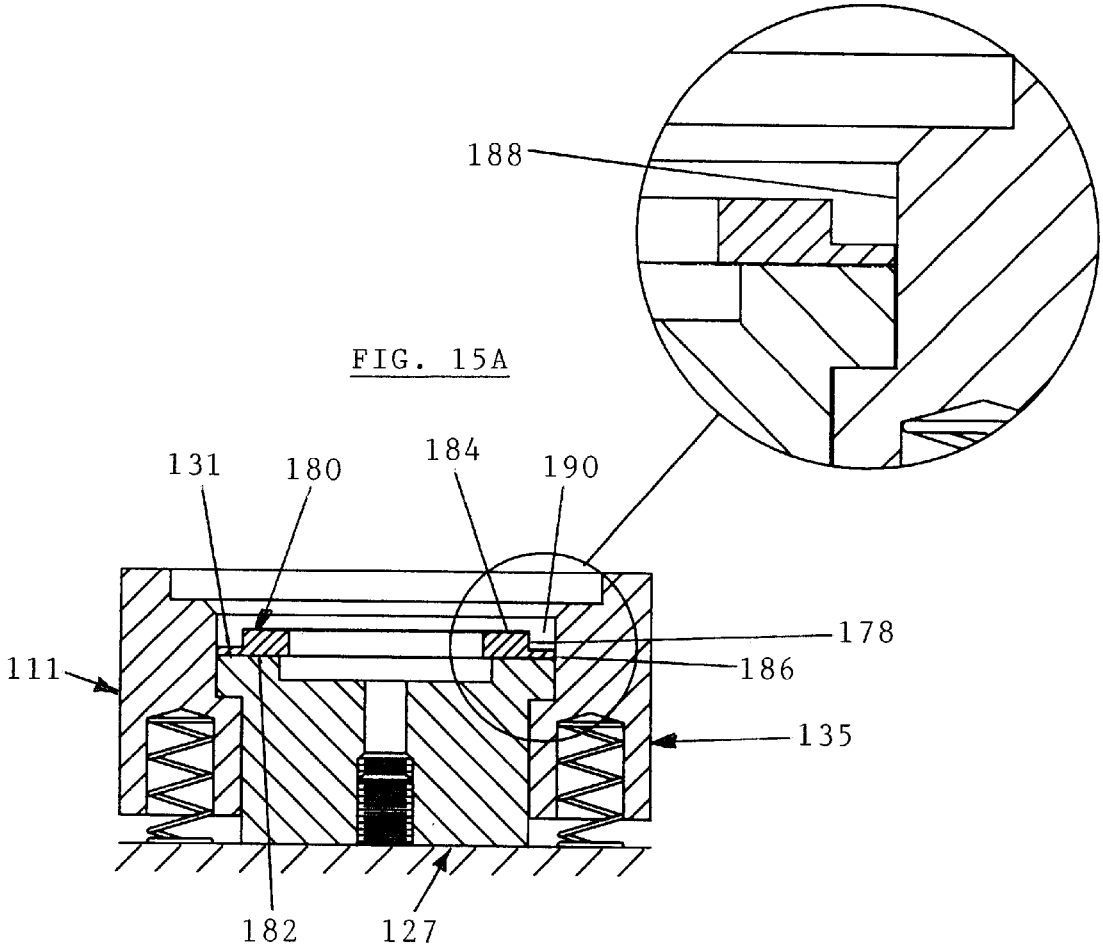
FIG. 15A is a view similar to FIG. 15, but showing a modified adapter according to the present invention.
Figures 3, 5, 15:
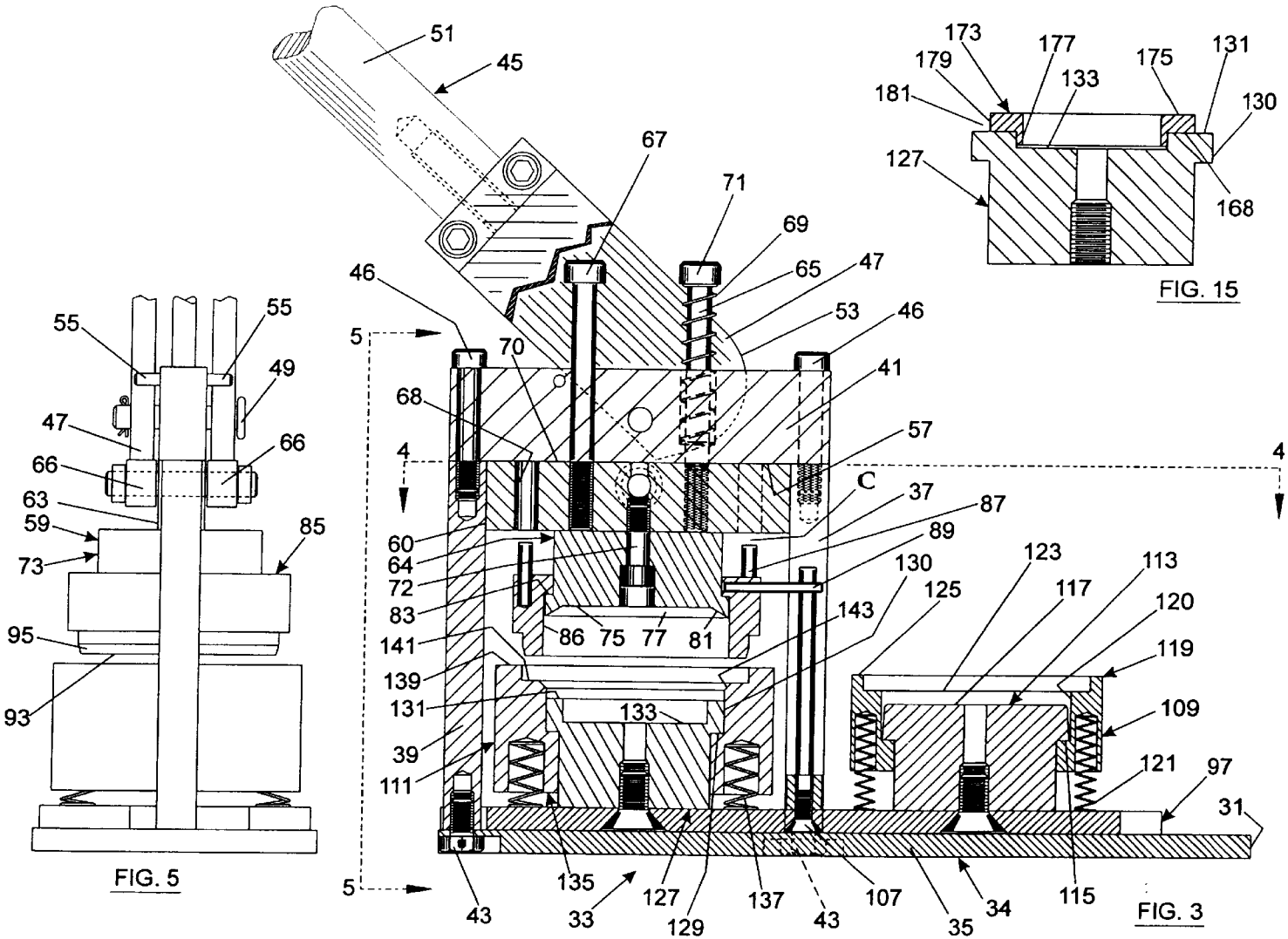
FIG. 3 is a broken cross sectional view taken along line 3—3 of FIG. 4 showing a universal assembly machine with the crimp die under the ram and the ram retracted.
FIG. 5 is a view taken along line 5—5 of FIG. 3.
FIG. 15 is a cross sectional view through the crimp die pedestal used to manufacture buttons with formed backs and adapted to also be capable of manufacturing buttons with flat backs and button medallions.
Figure 4A:
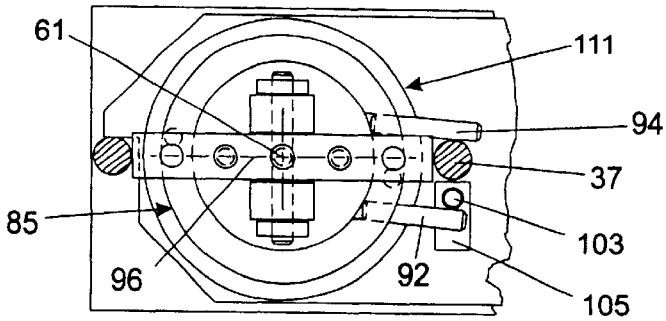
FIG. 4A is a view of an alternate construction for the fingers on the ram outer ring.
Figure 4:
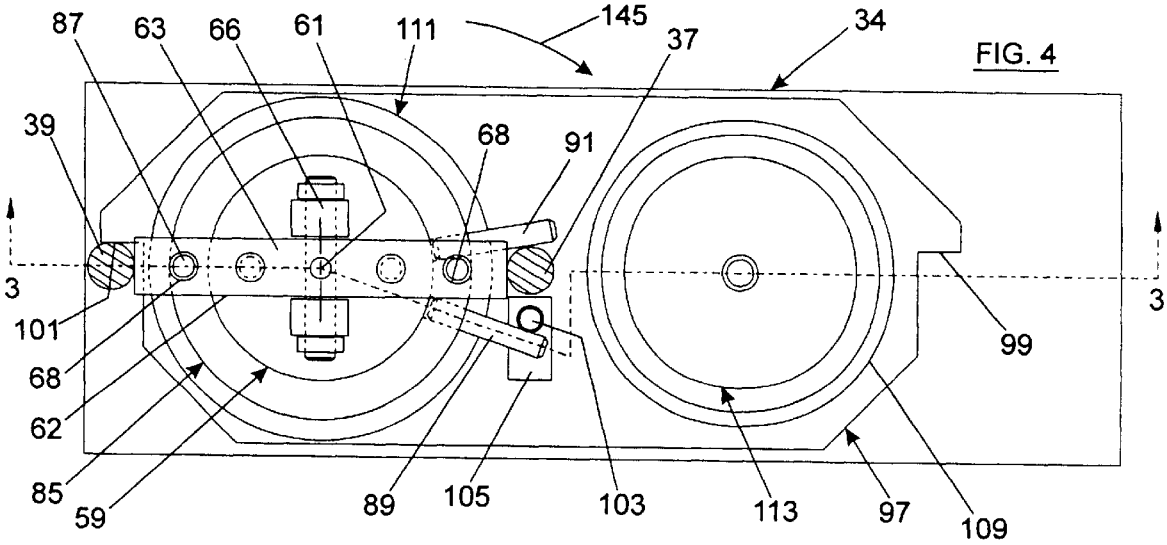
FIG. 4 is a view taken along line 4—4 of FIG. 3.

Referring first to FIGS. 3, 4, and 5, a universal assembly machine 33 is illustrated that is useful for economically manufacturing buttons 17 as shown in FIG. 1B. However, as will be explained in detail later, the assembly machine is also capable of manufacturing additional products.

The universal assembly machine 33 is comprised of a sturdy but simple and inexpensive box frame 34 that includes an elongated base 35. The base 35 is securable to a bench or other permanent installation. Upstanding from the base 35 is a center column 37 and a similar end column 39. The base end 31 opposite the end column 39 is at a considerable distance from the center column 37. Spanning the center column and the end column is a crown 41. Screws 43 and 46 are used to attach the crown 41, columns, and base into the box frame 34.

Pivotally connected to the crown 41 is a handle 45. In the illustrated construction, the handle 45 has a pair of plates 47 that straddle the crown and are pivotally connected to it by a pin 49. The plates 47 terminate in a hand grip 51. The plates have respective cam surfaces 53 opposite the grip 51. As shown in FIG. 3, the handle is in a ready position. In the ready position, the handle plates rest against pins 55 pressed in the crown. The cam surfaces 53 are above the crown undersurface 57.

A ram 59 is supported and guided by the crown 41 for reciprocating along a vertical axis 61, which preferably intersects the handle pin 49. The ram 59 includes a ram plate 63 and a ram die 64. The ram plate 63 is guided by one or more guide elements fixed in the ram plate and passing through associated guide holes in the crown. As illustrated, the guide elements are a pair of screws 65 and 67 threaded into the ram plate 63. The ram plate 63 is biased toward the crown undersurface 57 by a spring 69 acting between the head 71 of the screw 65 and a counterbore in the crown. If desired, a second spring, not shown but similar to the spring 69, can be used with the screw 67. Other than the handle 45, screws 65 and 67, and the spring 69, there are no parts of the machine 33 above the crown. There are a pair of holes 68 in the ram plate diametrically opposite the axis 61. A pair of rollers 66 extend oppositely from the sides 62 of the ram plate. When the handle 45 is in the ready position of FIG. 3, the handle cam surfaces are in close proximity to the rollers 66, but the handle cam surfaces do not exert any force on the rollers. The ends 60 of the ram plate are guide surfaces that are in close proximity to the end column 39 and the center column 37.

The ram die 64 is comprised of a cylindrical inner plug 73 and an outer ring 85. One face 70 of the inner plug 73 is fastened to the ram plate 63 by a screw 72. The opposite face 75 of the inner plug 73 is concave so as to define a cavity 77 having a tapered annular surface 81. As illustrated, the tapered annular surface 81 is flat. However, to better suit some buttons, a scalloped or curved surface can be used instead of a flat surface. There is an external shoulder 83 on the inner plug.

An outer ring 85 is slideable and rotatable over the outer diameter of the inner plug 73. The outer ring 85 has an internal diameter 86 and an internal shoulder that normally rests on the inner plug external shoulder 83 under the force of gravity. A pair of pins 87 are pressed into the outer ring at the same radial distance from the axis 61 as the holes 68 in the ram plate 63. When the handle 45 is in the ready position of FIG. 3, there is a clearance C between the pins 87 and the ram plate. A pair of fingers 89 and 91 jut outwardly from the ram outer ring. The fingers 89 and 91 are spaced angularly from each other. In the construction shown, the fingers jut radially from the vertical axis 61. The lower end of the outer ring 85 has an end surface 93 with a tapered pilot 95.

In FIG. 4A, an alternate design for the ram fingers is shown. The fingers 92 and 94 in FIG. 4A are parallel to each other. The fingers 92 and 94 are also on opposite sides of a transverse axis 96 through the vertical centerline 61.

Rotatably supported on the frame base 35 is a die table 97. For that purpose, there is a hole in the die table 97 through which the frame center column 37 passes. In the preferred embodiment, the die table 97 is indexable through 180 degrees about the frame center column. The opposite ends of the die table are formed with first and second cutouts 99 and 101, respectively. The cutouts 99 and 101 are located such that they are contactable with the outer column 39 of the frame 34. A vertical shifter post 103 is joined to the die table. As shown, the shifter post is pressed into a block 105 that in turn is held to the die table by a screw 107. The shifter post is long enough to reach the fingers 89 and 91 (FIG. 4) or 92 and 94 (FIG. 4A). Mounted to opposite ends of the die table 97 are a pickup die 109 and a crimp die 111. The pickup die 109 comprises a cylindrical pedestal 113 having an external shoulder 115 and a top surface 117. An outer ring 119 with an inner diameter 120 is slideable over the pedestal 113. Springs 121 bias an internal shoulder of the outer ring 119 against the pedestal external shoulder 115. The outer ring has a counterbore 123 in the upper surface 125 thereof.

The crimp die 111 has a pedestal 127 with an external shoulder 129, an outer diameter 130, and an upper surface 131 with a counterbore 133. A crimp die outer ring 135 is biased by springs 137 such that an internal shoulder abuts the pedestal external shoulder 129. The upper surface 139 of the outer ring 135 has a counterbore 141 and a tapered surface 143. The tapered surface 143 is shown as being flat. However, like the tapered surface 81 in the ram inner plug 73, the tapered surface 143 can be scalloped or curved to suit the particular button to be assembled.

Operation

Figure 7:
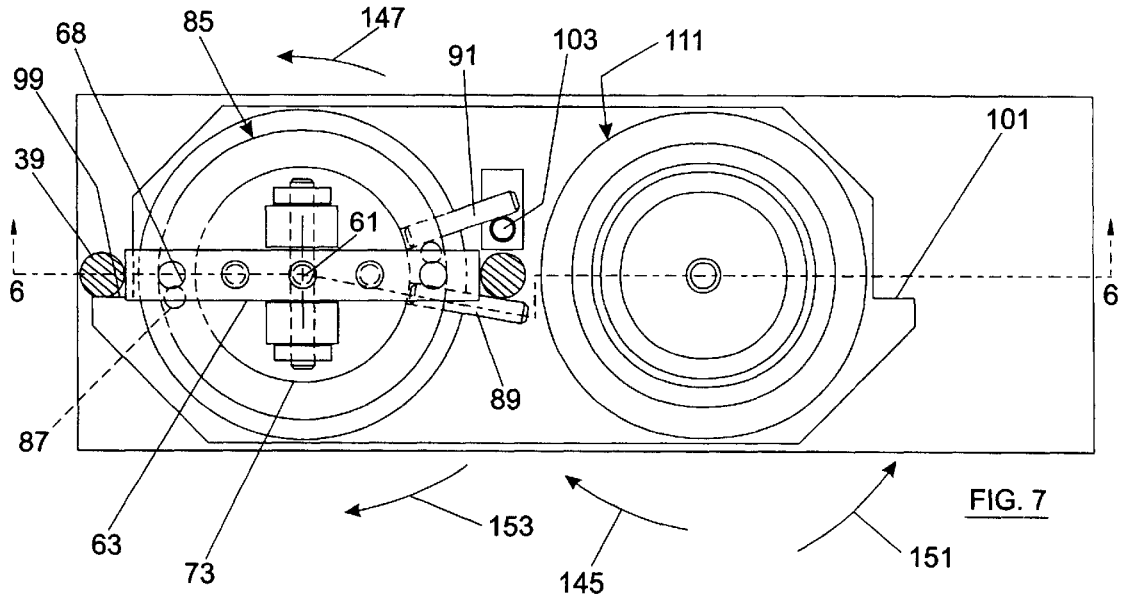
FIG. 7 is a view taken along line 7—7 of FIG. 6.
Figure 6:
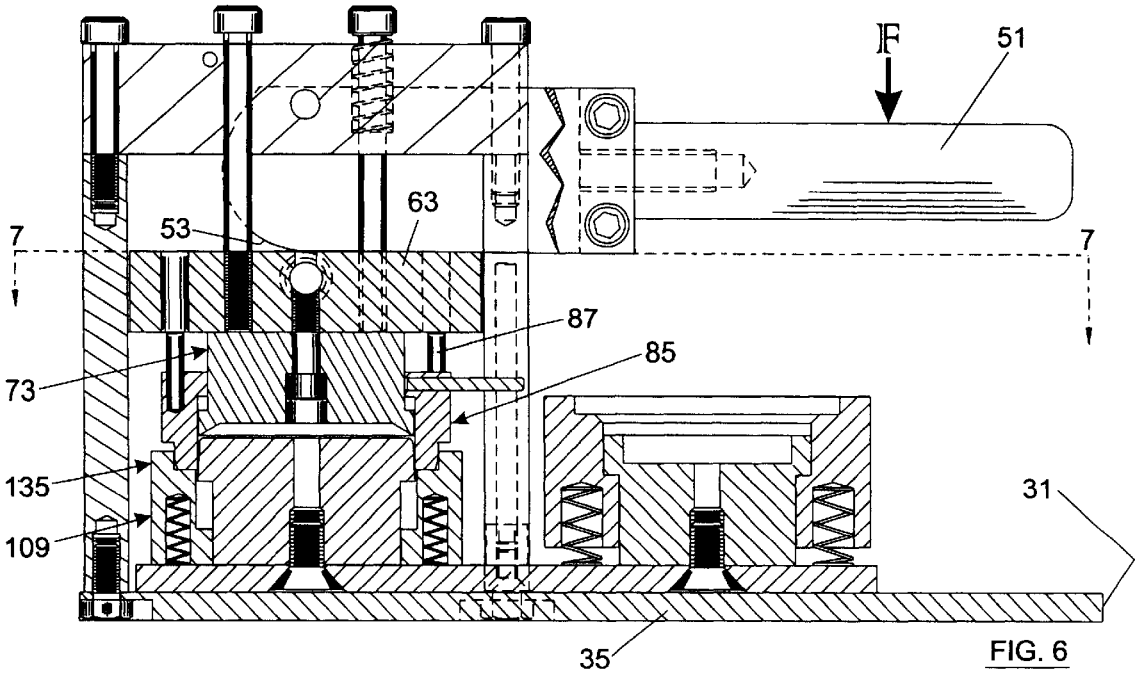
FIG. 6 is a broken cross sectional view taken along line 6—6 of FIG. 7 and showing the pickup die under the ram and the ram advanced in a pickup stroke.

The operation of the universal assembly machine 33 to manufacture a button 17 begins by placing a shell 7 dome side up on the pedestal 113 of the pickup die 109. See FIG. 9A. The laminate 1 is placed in the counterbore 123 of the pickup die outer ring 119. The machine die table 97 is indexed in the direction of arrow 145 about the machine frame center column 37 such that the pickup die is under the ram 59, FIG. 4. When the cutout 99 in the die table contacts the frame outer column 39, the pickup die is properly under the ram, as is shown in FIG. 6. When the die table indexes in the direction of arrow 145, the shifter post 103 also travels in a semi-circle about the center column to its position shown in FIG. 7. The circular travel of the shifter post causes it to contact the finger 91 and rotate the ram outer ring 85 on the ram inner plug 73 in the direction of arrow 147 to a pickup mode. The fingers 89 and 91, the shifter post, and the center column are so dimensioned and located relative to each other that the finger 89 is close to the center column, and the finger 91 is close to the shifter post. The center column and shifter post thus positively hold the ram outer ring in place against further rotation until the die table is again indexed. If parallel fingers 92 and 94 are used, FIG. 4A, they, too, are so dimensioned as to cooperate with the shifter post and center column to positively hold the ram outer ring in place. When the ram outer ring is in the pickup mode of FIG. 7, the pins 87 in the outer ring are misaligned with the holes 68 through the ram plate 63.

The handle 45 is pivoted under a force F clockwise with respect to FIGS. 3 and 6 in a pickup stroke to a generally horizontal working position. The handle cam surfaces 53 contact the roller 66 and force the ram plate 63 downwardly against the spring 69. Because of the rollers 66, there is only low-friction rolling contact between the ram plate and handle. The center column 37 and end column 39 guide the ends of the ram plate and supplement the guidance provided by the screws 65 and 67. The ram 59 advances to bring the end surface 93 of the ram outer ring 85 into contact with the laminate 1, FIG. 9A. A slight further pivoting of the handle advances the ram inner plug 73, but not the ram outer ring, which is resisted against motion at that time by the springs 121 acting through the pickup die outer ring 119, until the clearance C between the ram plate 63 and the pins 87 is taken up. Further advancement of the ram causes the ram outer ring to force the pickup die outer ring against the springs 121 and form the laminate over the shell 7, FIG. 9B. A wrinkled skirt 11 of the laminate overhangs the shell. Simultaneously, the laminate and shell slide into the inner diameter 86 of the ram outer ring.

It will be noticed in FIG. 6 that the frame base 35 underlies the force F that the operator exerts on the handle grip 51 when the handle 45 is at the working position. As a result, the force F does not cause the universal assembly machine 33 to tip over. To be certain of machine stability, the base end 31 extends beyond the end of the handle. That is, the end of the handle grip 51 does not overhang the base end 31.

Figure 9A:
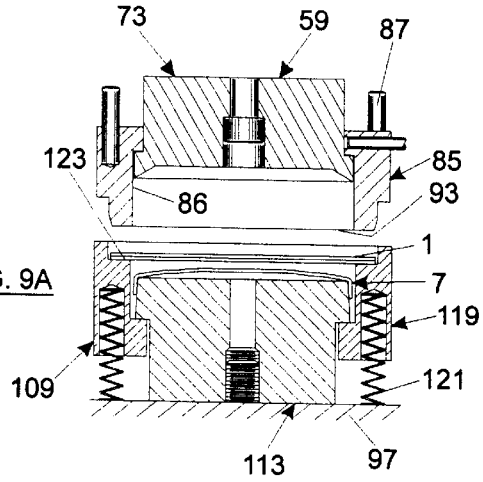
FIGS. 9A–9C are cross sectional views through the ram and the pickup die showing the pickup function of the universal assembly machine.
Figure 9B:
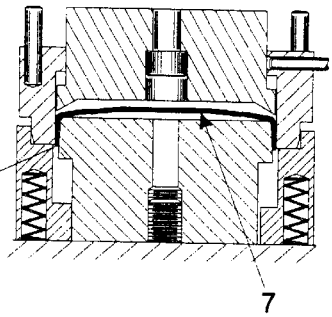
Figure 9C:
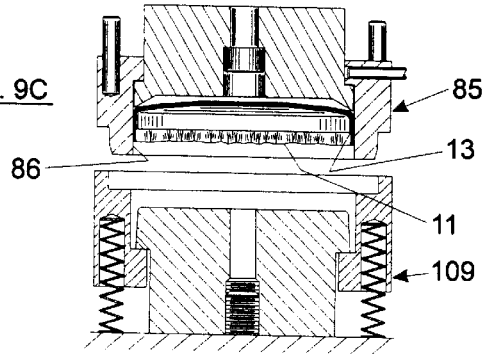

When the handle is pivoted back to the ready position of FIG. 3, the spring 69 retracts the ram 59 away from the pickup die 109, FIG. 9C. At the end of the pickup stroke, the shell 7 and laminate 1 are held by friction in the inner diameter 86 of the ram outer ring 85.

A formed back 9 having a frusto-conical outer wall 15 is placed on the pedestal 127 of the crimp die 111. See FIG. 10A. Although not shown, any of a number of different findings, such as safety pins, clutch pins, jump rings, and up-eyes, as are well known in the art, can be incorporated into the formed back. Such findings fit loosely within the counterbore 133 of the crimp die pedestal. The die table 97 is then indexed 180 degrees in the direction of arrow 151, FIG. 7. The cutout 101 in the die table contacts the machine frame end column 39 to locate the crimp die 111 under the ram 59, FIG. 8. Indexing the die table causes the shifter post 103 to travel an arcuate path in the direction of arrow 151. The shifter post contacts the finger 89 in the ram outer ring 85. The shifter post acts against the finger 89 to rotate the ram outer ring in the direction of arrow 153 to a crimp mode as shown in FIG. 4. When the ram outer ring is in the crimp mode, the pins 87 are aligned with the holes 68 in the ram plate 63, the finger 89 is proximate the shifter post, and the finger 91 is proximate the center column 37. The ram outer ring is then positively retained in the crimp mode by the coaction of the fingers 89 and 91, the shifter post, and the center column. The operation of the ram outer ring is the same if the parallel fingers 92 and 94 of FIG. 4A are used instead of the radial fingers 89 and 91.

The handle 45 is pivoted clockwise (with respect to FIG. 3) in a crimp stroke. See FIGS. 10A–10C. The ram plate 63 advances, guided by the center column 37, end column 39, and screws 65 and 67, until the ram outer ring contacts the crimp die outer ring 135. Further pivoting of the handle causes the ram inner plug 73 to advance, but the springs 137, acting through the crimp die outer ring 135, prevent advancement of the ram outer ring 85. The pins 87 in the ram outer ring enter the holes 68 in the ram plate 63. The ram inner plug 73 thus advances without corresponding advancement of the ram outer ring. The ram inner plug advances to push the laminate 1 and the shell 7 out of the inner diameter 86 of the ram outer ring 85 such that the skirt 11 of the laminate contacts the tapered surface 143 of the crimp die outer ring. That action bends the skirt inwardly inside of the frusto-conical wall 15 of the formed back 9. Continued advancement of the ram inner plug forces the crimp die outer ring against the springs 137, which collapse to push the shell wall 19 over and around the back wall 15. Simultaneously, the laminate skirt is tucked at reference numeral 155 between the shell wall 19 and the back wall 15.

Final advancement of the ram inner plug 73 forces the free edge 13 of the shell 7, which is covered by the laminate 1, against the tapered surface 143 of the crimp die outer ring 135 and crimps the shell to create a frusto-conical wall 19. The laminate skirt 11 is tightly squeezed between the shell wall 19 and the frusto-conical wall 15 of the back 9.

Figure 8:
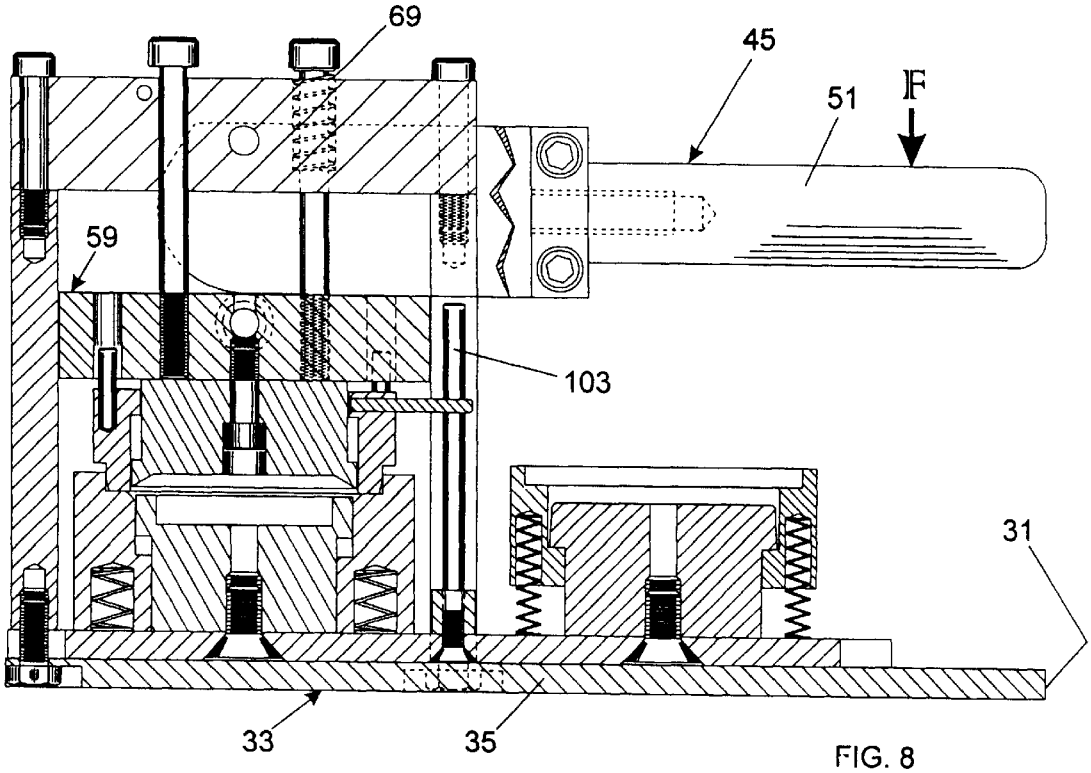
FIG. 8 is a view generally similar to FIG. 6, but showing the crimp die under the ram.

It will be noted from FIG. 8 that when the handle 45 is fully pivoted at the end of the crimp stroke, the grip 51 is over the machine base 35. The final advancement of the ram 59 to crimp the shell 7 requires that a moderate force be exerted on the handle grip. Having the handle grip over the machine base prevents the machine from tipping over and thus renders it stable during operation.

The handle 45 is then reversed, thereby retracting the ram 59 by means of the spring 69. The completed button 17, with its characteristic frusto-conical wall 19 and tucked skirt 11, is removed from the crimp die 111. The universal assembly machine 33 is then ready to manufacture another button 17.

Button With Flat Back

Figure 11:
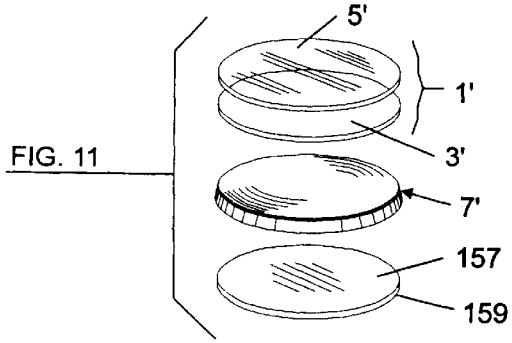
FIG. 11 is an exploded perspective view of a button made with a flat back in accordance with the present invention.
Figure 11A:
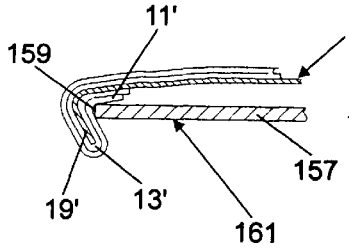
FIG. 11A is a cross sectional view of the assembled button with a flat back according to the present invention.

The universal assembly machine 33 is also capable of manufacturing buttons having flat backs. Turning to FIGS. 11 and 11A, a laminate 1' has a transparent film 5' that overlays a piece of artwork 3' in the same manner as the laminate 1 of FIG. 1. The laminate 1' is used with a conventional shell 7'.

Reference numeral 157 indicates a flat back in the form of a disk having a circular periphery 159. The flat back 157 may be made of metal. However, I have found that a flat back made of a hard plastic and having a thickness of approximately 0.04 inches also works very well. The flat back is placed against the shell 7' in a manner that tucks a skirt 11' of the laminate 1' between the back periphery 159 and the wall 19' of the shell 7'. The shell wall 19' is crimped around the flat back periphery 159 to form the characteristic frusto-conical wall 19' and tucked skirt 11' on the completed flat back button 161.

To manufacture the flat back button 161, the only modification required to the machine 33 is a different pedestal for the crimp die. Looking at FIGS. 12A–12C, the crimp die 163 has a crimp die outer ring 135' and springs 137' that are the same as the outer ring 135 and springs 137, respectively, of the crimp die 111 described previously. The pedestal 165 of the crimp die 163 has an external shoulder 129' that is in the same location relative to the die table 97 as the shoulder 129 of the crimp die pedestal 127 of the crimp die 111. However, the pedestal 165 has a top surface 167 that lies in a plane that is at a greater distance from the die table 97 than the top surface 131 of the crimp die pedestal 127. The shoulder 129' terminates in a pedestal outer diameter 171. There is a step in the pedestal outer diameter 171 opposite the shoulder 129' so as to form an annular notch 169 adjacent the pedestal top surface 167 and the pedestal outer diameter 171.

The process for manufacturing a flat back button 161, using the universal assembly machine 33 with the crimp die pedestal 165, is very similar to the process for the button 17 using the crimp die pedestal 127. The process begins by loading a laminate and shell in the pickup die 109 in the same manner as shown in FIG. 9A. The laminate and shell are captured in the ram outer ring 85 as previously described in connection with FIGS. 9B and 9C.

Figure 12A:
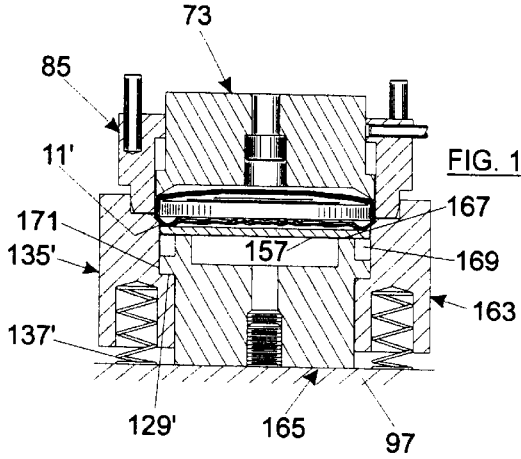
FIGS. 12A–12C are cross sectional views through the ram and a modified crimp die used to manufacture the button with the flat back of FIGS. 11 and 11A.
Figure 12B:
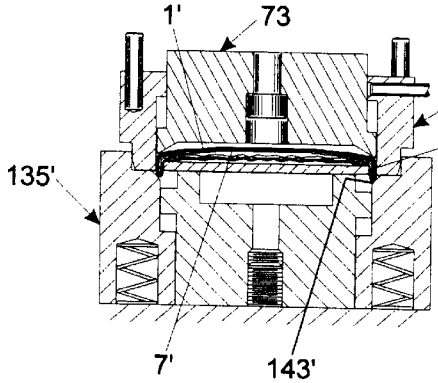
Figure 12C:
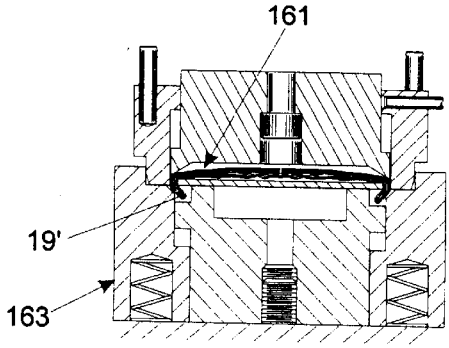

Looking at FIG. 12A, a flat back 157 is placed on the top surface 167 of the crimp die pedestal 165. After indexing the machine die table 97 to place the crimp die 163 under the machine ram 59, the handle 45 is pivoted to advance the ram 59 in a crimp stroke. The ram inner plug 73 pushes the laminate 1' and shell 7' out of the ram outer ring 85. Continued advancement of the ram causes the laminate skirt 11' to contact the tapered surface 143' of the crimp die outer ring 135', FIG. 12B. Further ram advancement causes the skirt to bend inwardly on top of the flat back and to tuck between the flat back periphery 159 and the wall 19' of the shell. The free edge 13' of the shell contacts the crimp die outer ring tapered surface 143' and crimps inwardly within the notch 169. FIG. 12C shows the final working position of ram advance, at which position the button 161 with the flat back is completed. The shell of the button 161 has the characteristic frusto-conical wall 19' and tucked skirt 11'.

Crimp Die Adapter

In accordance with the present invention, the versatility of the universal assembly machine 33 is further exemplified by the fact that the button 161 with the flat back 157 can be manufactured without substituting the crimp die pedestal 165 for the crimp die pedestal 127. With reference to FIG. 15, the crimp die pedestal 127 used to assemble the button 17 is shown, having the top surface 131 and counterbore 133. An adapter 173 is used with the pedestal 127 to simulate the crimp die pedestal 165, described previously, used to assemble the button 161. The adapter 173 has a top surface 175, an undercut surface 168, and a pilot 177. When the adapter undercut surface 168 is placed on the pedestal top surface 131 with the adapter pilot 177 inside the pedestal counterbore 133, the adapter top surface 175 is in the same relative location as the top surface 167 of the pedestal 165, FIGS. 12A–12C. An outer diameter 179 of the adapter is smaller than the outer diameter 130 of the pedestal. There is thus an annular notch 181 surrounding the adapter outer diameter 179 adjacent the adapter top surface 175.

FIG. 15A shows a modified adapter 180 in place in the crimp die 111. The adapter 180 has a bottom surface 182, a top surface 184, an outer cylindrical surface 186, and a second outer cylindrical surface 178. When the adapter bottom surface 182 is placed on the top surface 131 of the crimp die pedestal 127, the adapter top surface 184 is in the same relative location as the top surface 167 of the crimp die pedestal 165, FIGS. 12A–12C. The adapter outer surface 186 is guided by the inner diameter 188 of the crimp die outer ring 135. When the adapter 180 is in place, there is an annular notch 190 between the adapter cylindrical surface 178 and the inner diameter 188 of the crimp die outer ring 135 adjacent the adapter top surface 184.

Figure 10A:
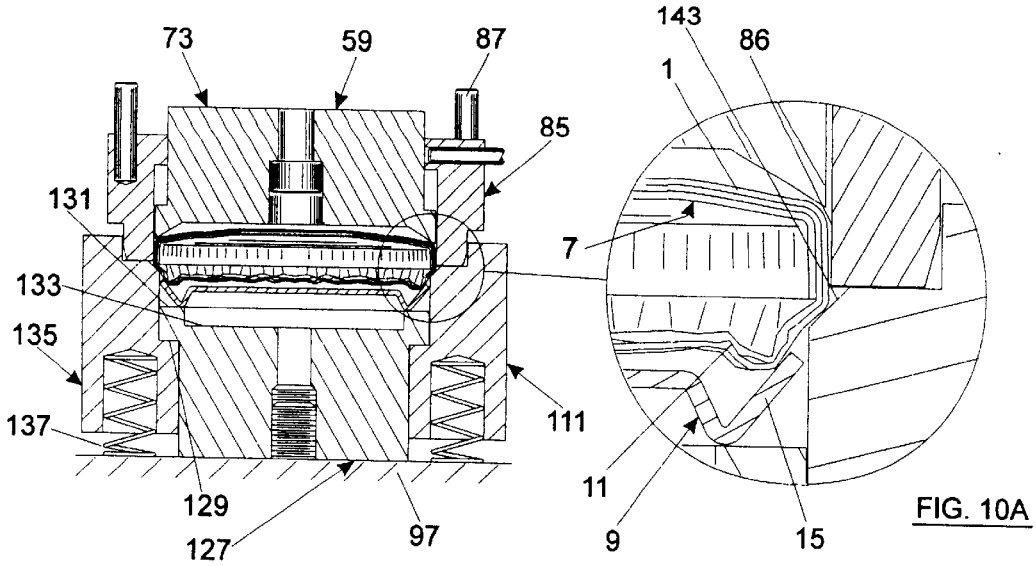
FIGS. 10A–10C are cross sectional views through the ram and the crimp die showing the crimp function.
Figure 10B:
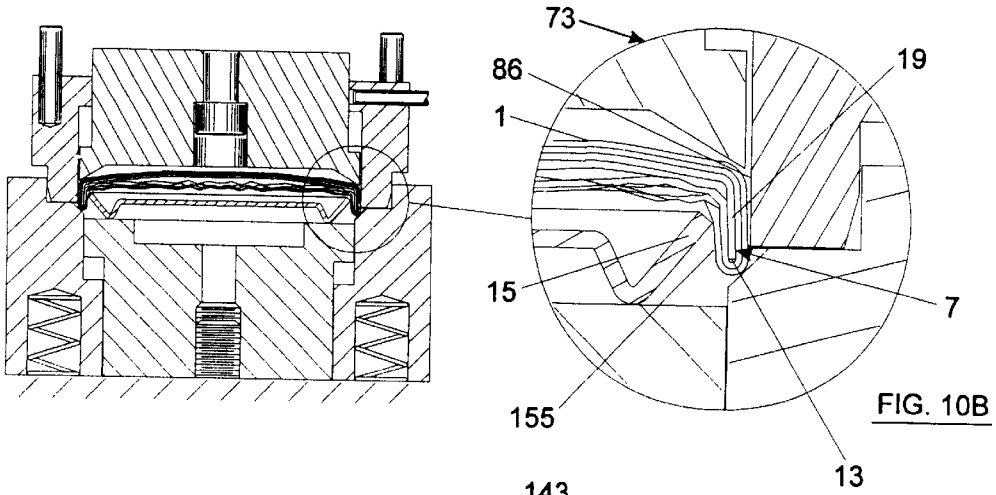
Figure 10C:
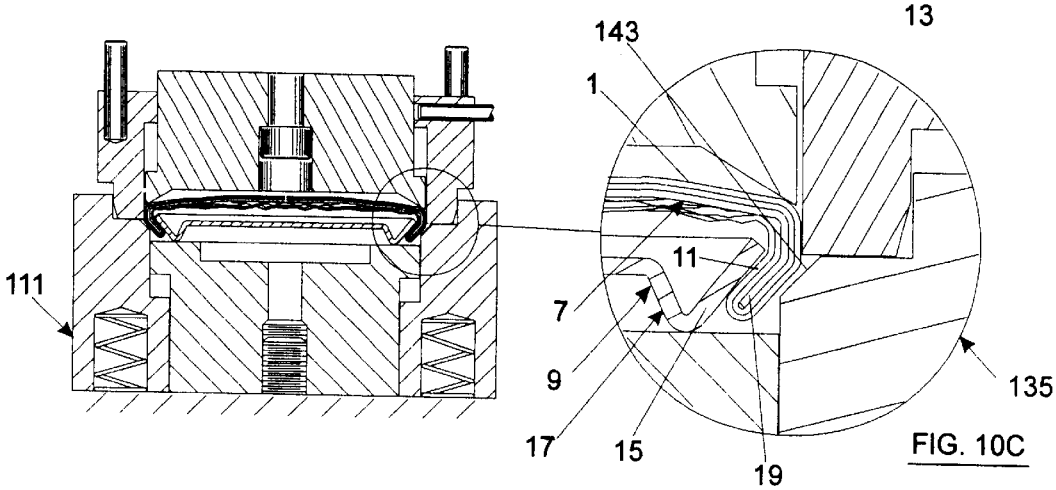

By using the adapter 173 or 180, the crimp die pedestal 127, which is used to make the button 17 as explained with reference to FIGS. 10A–10C, can also be used to make the flat back button 161 as explained with reference to FIGS. 12A–12C. In other words, the crimp die pedestal 127 and adapter 173 or 180 are interchangeable with the crimp die pedestal 165. The adapters 173 and 180 thus contribute greatly to the economy of the universal assembly machine 33.

Button Medallion

Figure 13:
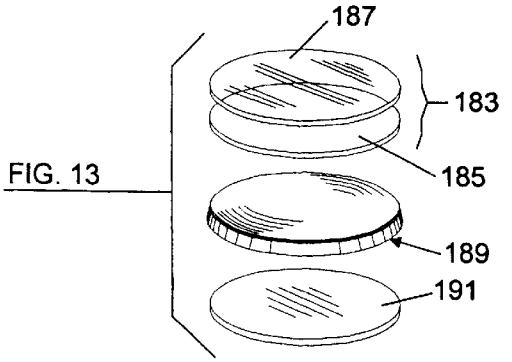
FIG. 13 is an exploded perspective view of a button medallion according to the present invention.
Figure 13A:
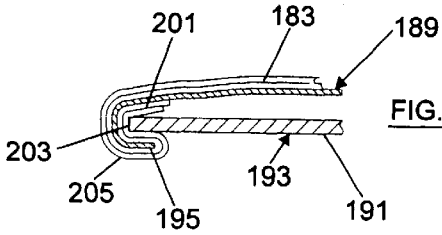
FIG. 13A is a cross sectional view on an enlarged scale of an assembled button medallion according to the present invention.
Figure 2A:
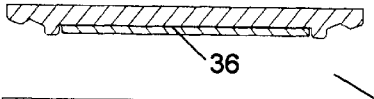
FIG. 2A PRIOR ART
FIG. 2A is a cross sectional view taken along line A—A of FIG. 2.
Figure 2B:
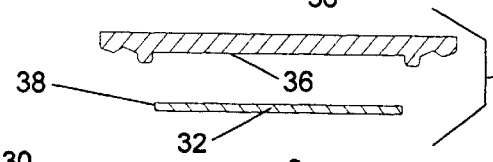
FIG. 2B PRIOR ART
FIG. 2B is a cross sectional view similar to FIG. 2A, but showing the trophy and medallion in exploded form.
Figure 2:
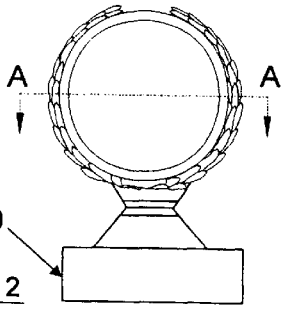
FIG. 2 is a front view of a typical trophy and prior medallion.
Figure 2C:
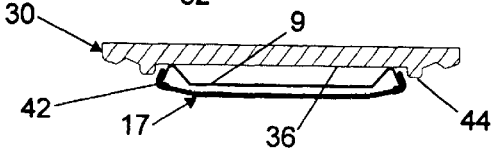
FIG. 2C PRIOR ART
FIG. 2C is a view generally similar to FIG. 2A, but showing a button in a trophy recess.

Button medallions are also capable of being manufactured by the universal assembly machine 33. For the purposes of this invention, a button medallion is a multi-component product as shown in FIGS. 13 and 13A. A flexible laminate 183 consists of a piece of artwork 185 and a protective transparent film 187. Reference numeral 189 indicates domed shell, and reference numeral 191 indicates a flat back. The laminate 183, shell 189, and flat back 191 are assembled together to make a button medallion 193. The characteristic features of the button medallion 193 are that its outer diameter is a size that fits in the recess of a common award component, such as the trophy 30, FIG. 2; the margin 195 of the shell wall 199 is parallel to the plane of the back 191; and its outer edge 206 is as thin as the incorporated materials allow.

In its initial condition prior to any transformation performed according to the present invention, the domed shell 189 has an appearance generally similar to the shell 7 of FIG. 1A. That is, the shell 189 has an outer surface 209, an inner surface 211, and an annular wall 199 with a free edge 198.

The button medallion 193 is manufactured by using a third press stroke on the machine 33. The shell outer surface 209 is covered with the laminate 183. The laminate 183 and shell 189 are loaded in the machine pickup die 109 as described previously in conjunction with FIG. 9A. Then a pickup stroke is performed as described previously in connection with FIGS. 9B and 9C. After a back 191 is loaded in the crimp die 163, a crimp stroke is performed as described in conjunction with FIGS. 12A–12C. For the crimp stroke, a crimp die with either the crimp die pedestal 127 with either the adapter 173 of FIG. 15 or the adapter 180 of FIG. 15A, or the crimp die pedestal 165 of FIGS. 12A–12C, can be used. It will be recognized that at the end of the crimp stroke, FIG. 12C, a flat back button, similar to the flat back button 161 of FIG. 11A, has been produced. The flat back button is produced as an intermediate step in making the button medallion.

Figure 14A:
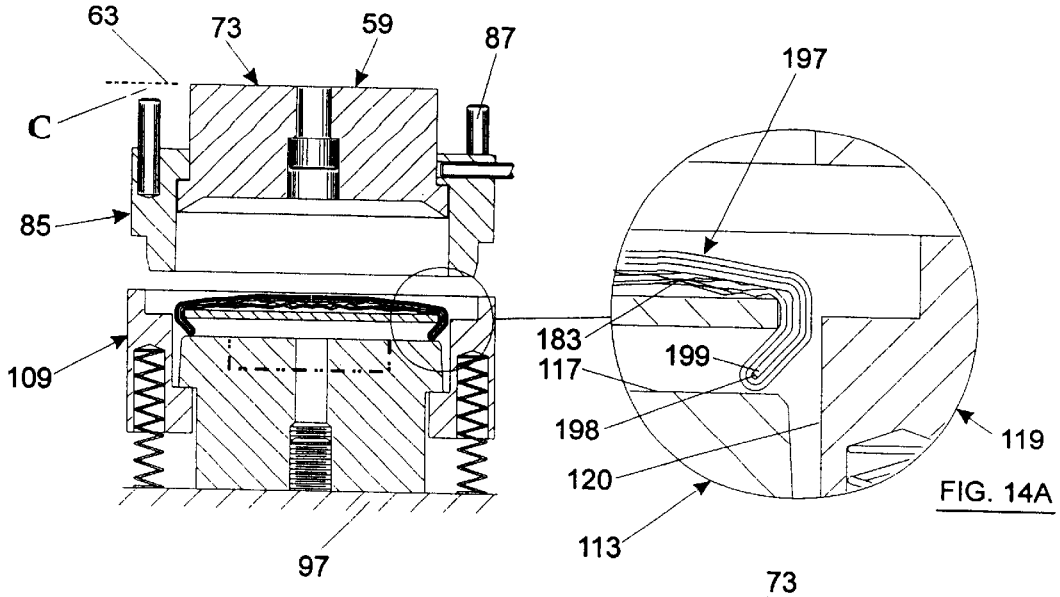
FIGS. 14A–14C are cross sectional views through the ram and the pickup die showing the third press stroke used during the manufacture of the button medallion of FIGS. 13 and 13A.

Looking at FIG. 14A, the flat back button as the intermediate step to making the button medallion 193 is indicated at reference numeral 197. The annular wall 199 of the shell 189 of the flat back button 197 has a frusto-conical margin 195.

To complete the manufacture of a button medallion 193 (FIG. 13A), the flat back button 197 is removed from the crimp die 163 (FIG. 12C) and is loaded back into the pickup die 109, FIG. 14A. The free edge 198 of the shell annular wall 199, covered with the tucked laminate 183, rests on the upper surface 117 of the pickup die pedestal 113. It will be noted that the outer diameter of the flat back button 197 is smaller than the inner diameter 120 of the pickup die outer ring 119. The machine die table 97 is indexed to place the pickup die under the ram 59. That action causes the shifter post 103 to contact the finger 91 and rotate the ram outer ring 85 to the pickup mode whereat the pins 87 are out of alignment with the holes 68 in the ram plate 63. As will be recalled, the finger 91 is proximate the shifter post 103 and the finger 89 is proximate the center column 37 when the ram outer ring is in the pickup mode.

Figure 14B:
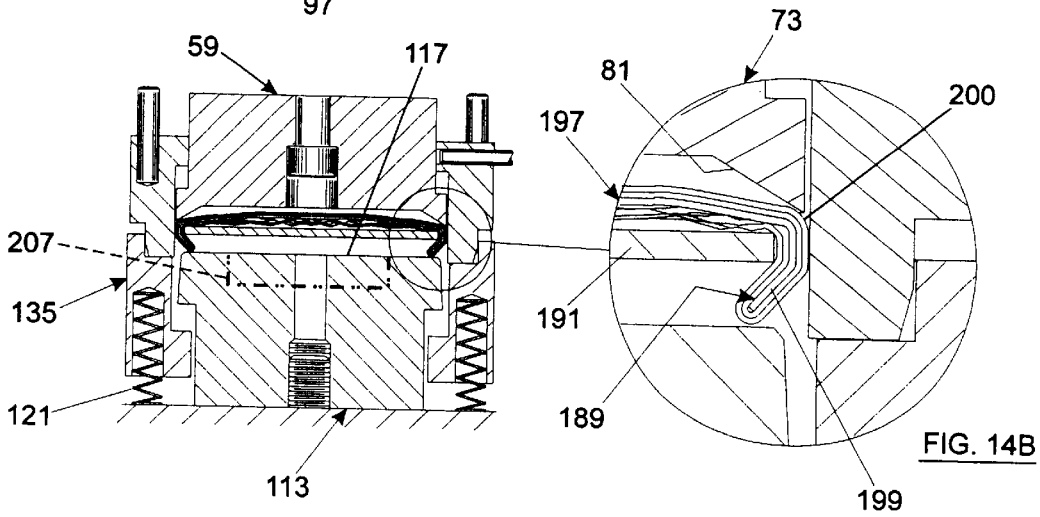
Figure 14C:
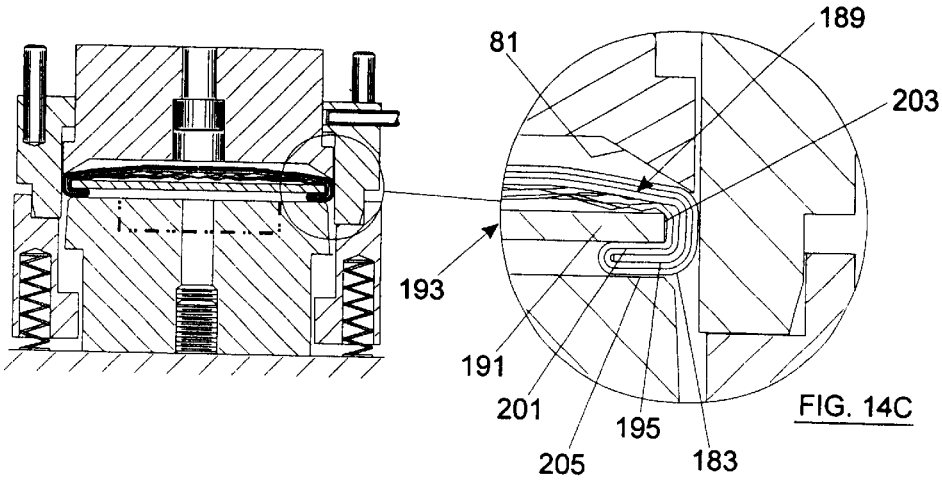

The handle 45 is pivoted in a third press stroke to advance the ram 59, ram plate 63, inner plug 73, and outer ring 85 until the ram outer ring contacts the pickup die outer ring 119, FIG. 14B. Further pivoting of the handle advances the ram inner plug and ram plate together to take up the clearance C. Continued advancement of the ram causes compression of the springs 121 and the tapered surface 81 of the ram inner plug 73 to contact the front end 202 of the periphery 200 of the flat back button 197. Final ram advancement forces the previously formed frusto-conical margin 195 of the shell 189 to press against the surface 117 of the pickup die pedestal 113 and form inwardly, undergoing compressive forces, tightly against the back 191, FIG. 14C. At that point, the previous frusto-conical margin 195 has bent to be parallel to the back 191, FIG. 13A. The flexible laminate 183 is tucked at reference numeral 201 around the back periphery 203 and between the shell inner surface 211 and the back 191.

Figure 16:
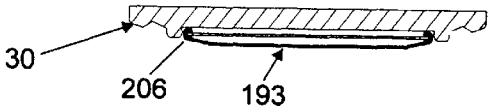
FIG. 16 is a cross sectional view through a trophy recess showing a button medallion according to the present invention with the thin outer edge thereof substantially hidden in the recess and bonded to the recess seat.
Figure 1C:
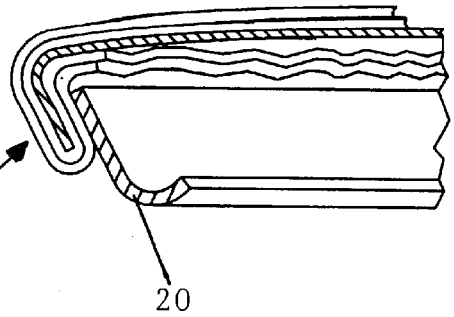
FIG. 1C is a view similar to FIG. 1B, but showing a button made with a collet.

At the end of the third press stroke, the ram 59 is retracted to yield a completed button medallion 193. The flat planar wall 195 enables adhesive to be applied to the flat back 191, as well as to the laminate 183 in the area 205, to join the button medallion to a conventional trophy, FIGS. 2 and 16. The three-dimensional appearance of the button medallion of the invention gives a much richer appearance to the artwork 185 compared with the prior flat medallions 32 (FIGS. 2A and 2B) and is thus a major improvement over the prior medallions. Further, the thin edge 206 of the button medallion 193 is thin enough to be substantially hidden in the trophy recess.

Because of the thin edge 206 of the button medallion 193, it is eminently suitable for other uses than in the recesses of trophies and other awards. In fact, the thin edge 206 makes the button medallion 193 eminently suitable for use with non-recessed applications. Flat surfaces such as those on award plaques, for which prior medallions 32 were unsuitable, can readily use the button medallion of the invention. The universal assembly machine 33 can easily manufacture button medallions up to approximately six inches in diameter. Consequently, customized decorative additions to trophies and similar items are no longer limited to the one or two inch diameters of the prior medallions. Other applications for the button medallions include embellishments for various types of packaging.

In some applications, it may be desirable to have a finding incorporated into the button medallion 193. In those cases, the particular finding is attached to the flat back 191 in any suitable manner. A counterbore is machined in the top surface 117 of the pickup die pedestal 113, as is shown by phantom lines 207, FIGS. 14A–14C, to accommodate the finding during the third press stroke.

In summary, the results and advantages of buttons 17 with formed backs 9 and buttons 161 with flat backs 157 can now be more fully realized. The universal assembly machine 33 provides efficient manufacture of both kinds of buttons. This desirable result comes from using the combined functions of the crimp die pedestal 127. Indexing the die table about the column 37 of the box frame 34 places the desired pickup die 109 or crimp die 111 under the ram 59, and simultaneously rotates the ram outer ring 85 by means of the shifter post 103 to the corresponding pickup mode or crimp mode. Consequently, only two machine operations are necessary to manufacture a button: indexing the die table and pivoting the handle 45. By changing the crimp die pedestal, the button 161 with the flat back 157 can be manufactured. On the other hand, the adapter 173 enables the same crimp die pedestal 127 to be used for manufacturing both the flat back button and the button with the formed back.

It will also be recognized that in addition to the superior performance of the universal assembly machine 33, its construction is such as to cost little if any more than traditional machines. The versatility and efficiency of the machine is further enhanced by the use of the adapter 173, which is far less costly than a crimp die pedestal 165.

Thus, it is apparent that there has been provided, in accordance with the invention, an adapter for a machine for manufacturing buttons that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In apparatus for assembling first and second buttons having formed backs with frusto-conical outer walls and flat backs with peripheries, respectively, including a ram die advancable into operative association with a crimp die to assemble an artwork and a shell to a selected formed back or flat back, the crimp die comprising a crimp die pedestal having a top surface at a first predetermined location relative to the ram die suitable for assembling the first button, an adapter having an adapter top surface, and an adapter second surface, the adapter being selectively placeable on and removeable from the crimp die pedestal, the adapter top surface being at a second predetermined location relative to the ram die suitable for assembling the second button when the adapter second surface is placed on the crimp die pedestal top surface, so that the same crimp die pedestal can be used for assembling both the first and second buttons.

2. In combination with a universal assembly machine for manufacturing flat back buttons and formed back buttons and comprising a ram die holding a laminate; a crimp die having a crimp die ring with an inner diameter, and a crimp die pedestal with a top surface having a counterbore therein and being at a first location suitable for cooperating with the ram die to manufacture a formed back button from the laminate and a formed back placed on the crimp die pedestal top surface; and means for advancing the ram die into operative association with the crimp die to assemble the formed back button, an adapter having a first surface placed on the crimp die pedestal top surface and a second surface that is at a second location suitable for cooperating with the ram die to manufacture a flat back button from the laminate and a flat back placed on the adapter second surface in response to advancing the ram die into operative association with the crimp die, so that both flat back and formed back buttons are manufactured using the crimp die pedestal.

3. The combination of claim 2 where in the adapter has a pilot that interfits with the counterbore in the crimp die pedestal to thereby locate the adapter within the crimp die.

4. The combination of claim 2 wherein the adapter has an outer surface that is guided by the inner diameter of the crimp die ring to thereby locate the adapter within the crimp die.

5. A method of manufacturing a flat back button comprising the steps of:

a. providing a universal assembly machine having a ram die and a crimp die with a crimp die pedestal with a top surface at a first predetermined location relative to the ram die;

b. placing an adapter having an adapter top surface on the crimp die pedestal top surface and thereby locating the adapter top surface at a second predetermined location relative to the ram die;

c. assembling a laminate and a shell having a wall in the ram die;

d. loading a flat back with a periphery on the adapter top surface; and e. advancing the ram die in a crimp stroke to cooperate with the adapter and the crimp die and assembling the laminate and shell to the flat back with the shell wall being proximate the flat back periphery.

* * * * *